US005161362A

United States Patent [19]

Stahlecker

[11] Patent Number: 5,161,362

[45] Date of Patent: Nov. 10, 1992

[54] NOISE-REDUCING ACCESS COVER AND YARN GUIDE FOR FALSE-TWIST AIR JETS

[75] Inventor: Fritz Stahlecker, Bad Überkingen, Fed. Rep. of Germany

[73] Assignee: Hans Stahlecker, Fed. Rep. of Germany; a part interest

[21] Appl. No.: 642,875

[22] Filed: Jan. 18, 1991

[30] Foreign Application Priority Data

Feb. 10, 1990 [DE] Fed. Rep. of Germany ..... 4004049

[51] Int. Cl.[5] ..... D01H 5/28

[52] U.S. Cl. ..... 57/328; 57/333

[58] Field of Search ..... 57/328, 344, 346, 350, 57/280; 28/271, 272, 258, 275

[56] References Cited

U.S. PATENT DOCUMENTS

| | | | |
|---|---|---|---|
| 3,379,002 | 4/1968 | Rosenstein | 57/350 X |
| 3,713,509 | 1/1973 | Caroll | 57/1 R X |
| 3,822,449 | 7/1974 | Dick | 28/272 |
| 3,905,075 | 9/1975 | Boggs et al. | 28/272 |
| 4,107,911 | 8/1978 | Yamana et al. | 57/261 X |
| 4,586,323 | 5/1986 | Lassiter et al. | 57/1 R |
| 4,819,419 | 4/1989 | Stahlecker et al. | 57/328 X |
| 4,941,242 | 7/1990 | Nabulon et al. | 28/272 X |

FOREIGN PATENT DOCUMENTS 3638110 5/1988 Fed. Rep. of Germany .

*Primary Examiner*—Daniel P. Stodola
*Assistant Examiner*—John Rollins
*Attorney, Agent, or Firm*—Evenson, Wands, Edwards, Lenahan & McKeown

[57] ABSTRACT

In the case of an arrangement for pneumatic false-twist spinning having air nozzles arranged behind a pair of drafting units, it is provided that the air nozzles lead into a space which is designed as a V-shaped groove which, together with a covering, is completed to form a yarn guiding duct which leads from the mouth of the air nozzles to a yarn outlet opening. The yarn guiding duct is provided with a cross-sectional enlargement in the area adjacent the air nozzle outlets to provide for uniform flow in the duct.

22 Claims, 2 Drawing Sheets

NOISE-REDUCING ACCESS COVER AND YARN GUIDE FOR FALSE-TWIST AIR JETS

BACKGROUND AND SUMMARY OF THE INVENTION

The invention relates to an arrangement for pneumatic false-twist spinning having at least one air nozzle arranged behind a drafting unit, which at least one air nozzle leads into a space provided with a covering that can be swivelled away and has a yarn outlet opening.

For the reduction of noise, it is known from U.S. Pat. No. 4,586,323 to provide a chamber which is covered by means of a covering following an air nozzle of an arrangement for pneumatic false-twisting spinning. This chamber has a yarn outlet opening from which the yarn emerges during the spinning operation. For a piecing operation, the covering of a servicing apparatus is opened so that a yarn intake pipe can be applied directly to the mouth of the air nozzle.

It is also known from German Patent Document DE-A 36 38 110, corresponding to U.S. Pat. No. 4,819,419, to cover the air nozzle toward the outside and the operating side of the machine with a covering which is constructed as a holding element for at least one air nozzle. In this case, it is also known to connect duct-type guiding elements to the mouth of the air nozzle. In an embodiment (FIG. 9), a bifurcated guiding element is connected to two adjacent air nozzles and the yarn guiding ducts of this guiding element leads the yarns together which leave the two adjacent air nozzles which are aligned in a V-shape with respect to one another.

It is an object of the invention to develop an arrangement of the initially mentioned type in such a manner that an effective noise reduction is obtained without any diminishing of the operability of the machine.

This object is achieved according to the invention in that the space is designed as a groove which, by means of a closed covering, is completed to form a yarn guiding duct which leads from the mouth of the air nozzle to the yarn outlet opening. In this manner, it is possible to cover the outlet area of the air nozzle, that is, the area in which the noise is mainly generated. The air can flow off by way of the yarn guiding duct, in the process exercising a transport effect on the spun yarn which can then be taken over at the yarn outlet opening for example, for a piecing operation—without the requirement of having to move the covering for this purpose. In this case, the yarn guiding duct acts as a calming zone for the air emerging from the air nozzle so that a flowing-away from the yarn outlet opening of the yarn guiding duct is not connected with any significant generating of noise.

Other objects, advantages and novel features of the present invention will become apparent from the following detailed description of the invention when considered in conjunction with the accompanying drawings.

DETAILED DESCRIPTION OF THE DRAWINGS

Figure 1:
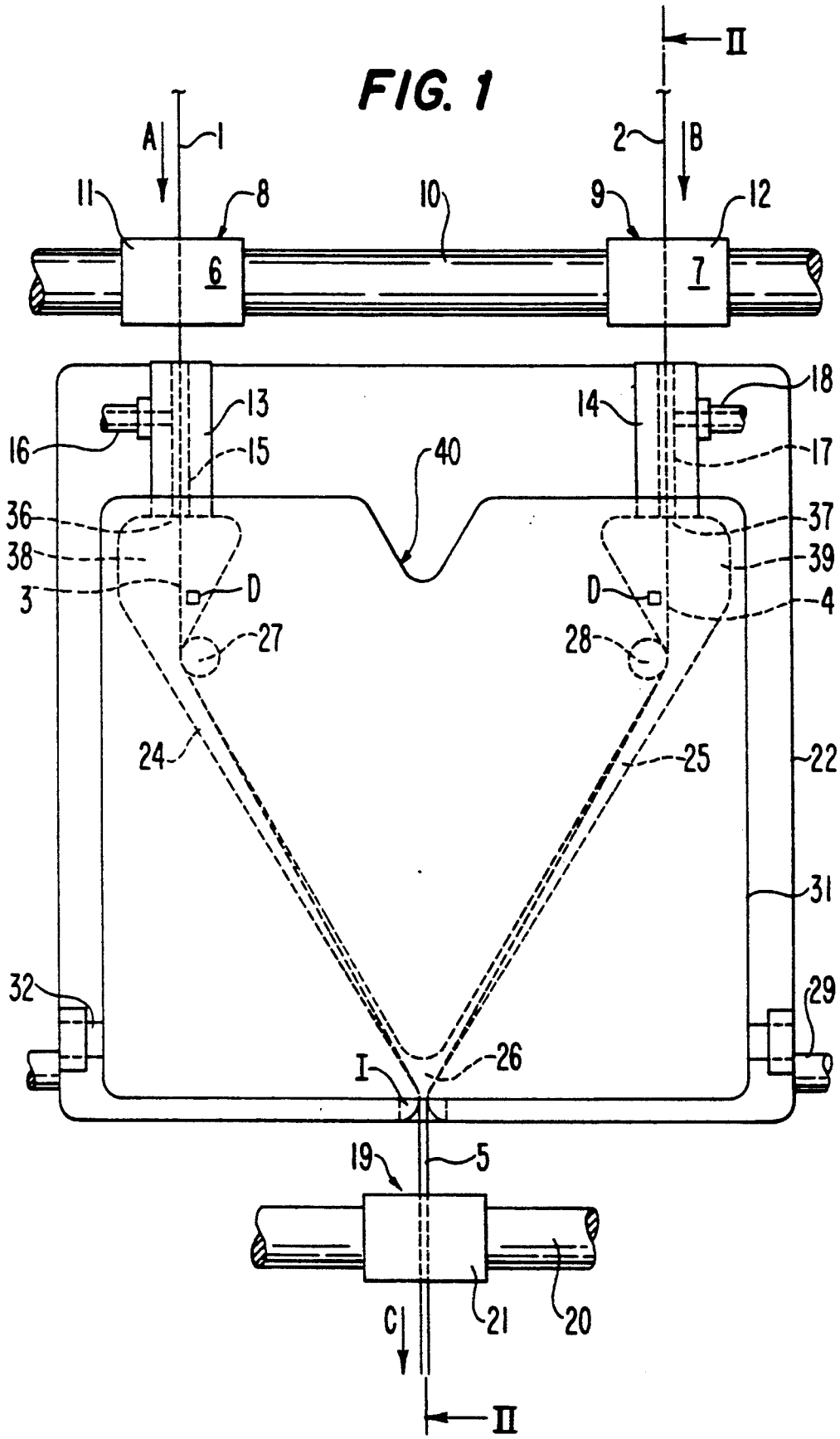
FIG. 1 is a front view from the direction of the operating side of an arrangement constructed according to a preferred embodiment of the invention.
Figure 2:
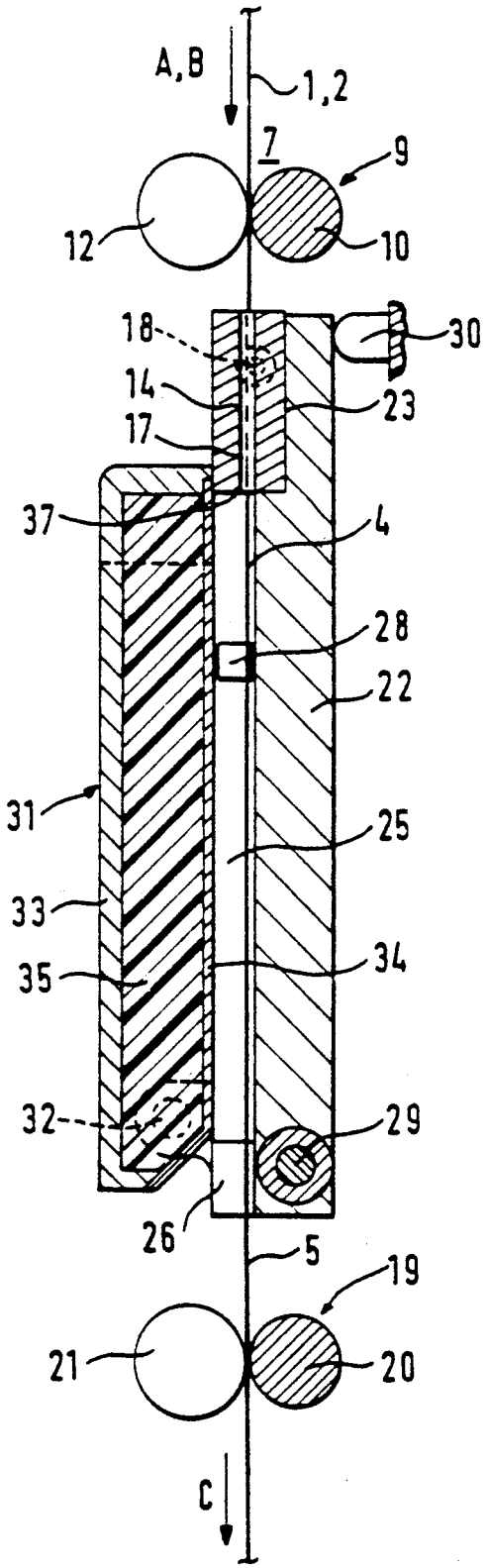
FIG. 2 is a sectional view taken along Line II—II of FIG. 1.

The arrangement for pneumatic false-twist spinning illustrated only partially in FIGS. 1 and 2 is part of a machine which on one side is equipped with a plurality of arrangements of this type which are arranged in a row behind one another. In the arrangement, two slivers 1, 2 are drawn to the desired yarn size and are subsequently spun into two yarns 3, 4 which are then guided together to form a double yarn 5 which, as a double yarn, is wound into a cross-wound package on a wind-up device which is not shown. The two yarns 3, 4 are only prestrengthened, and the final strength is provided to the double yarn 5 in a subsequent operation by which the double yarn 5 is twisted together.

The drafting of the slivers 1, 2 takes place in drafting units 6, 7 through which the slivers 1, 2 pass in the direction of the arrows (A and B). Only the respective pair of delivery rollers 8, 9 of these drafting units 6, 7 is shown. These two pairs of delivery rollers 8, 9 have a common bottom cylinder 10 which extends through in the longitudinal direction of the machine and is driven at a machine end, as well as one pressure roller 11, 12 respectively. The pressure rollers 11, 12 of the two drafting units 6, 7 are preferably constructed as so-called pressure roller twins which are held by a common loading support which is not shown.

The drafting units 6, 7 are followed by one air nozzle 13, 14 respectively in the travelling direction of the yarn. The air nozzles 13, 14, which are constructed in a known manner, each have a yarn duct 15, 17. Blow openings connected to compressed-air pipes 16, 18 lead into the yarn ducts 15, 17, are arranged tangentially with respect to the yarn ducts 15, 17, and cause a swirling flow with a preset rotating direction in the yarn ducts 15, 17. As a deviation from the only schematic representation of FIG. 1, additional air nozzles and/or yarn guiding elements may be arranged between the drafting units 6, 7 and the air nozzles 13, 14.

The yarns 3, 4 leaving the air nozzles 13, 14 are guided together in a V-shape and are withdrawn as a double yarn 5 by a withdrawal device 19. The withdrawal device 19 has a shaft 20 which extends through in the longitudinal direction of the machine and is driven at the machine end, as well as a pressure roller 21. The double yarn 5 which leaves the withdrawal device 19 in the direction of the arrow (C) is wound up to a package by a wind-up device which is not shown.

The air nozzles 13, 14 are held by a plate-shaped holder 22 which is provided with recesses 23 for the air nozzles 13, 14. These recesses 23 are constructed in such a manner that the yarn outlet openings 36, 37 of the air nozzles 13, 14 remain exposed as shown in FIG. 2. The yarn outlet openings 36, 37 of the air nozzles 13, 14 are followed by grooves 24, 25 which are worked into the plate-shaped holder 22 which is extended beyond the air nozzles 13, 14 in the travelling direction of the yarn. The grooves 24, 25 converge in a V-shape in the travelling direction of the yarn. In the area of the grooves 24, 25, the holder 22 is covered by means of a covering 31. In the area of the outlet openings 36, 37, the covering reaches sealingly over the air nozzles 13, 14. It also covers the grooves 24, 25 so that the grooves 24, 25, together with the covering 31, form yarn guiding ducts which extend to a common yarn outlet opening 26.

As shown in FIG. 1, the grooves 24, 25 have one cross-sectional widening 38, 39 respectively in the area of the outlet openings 36, 37 of the air nozzles 13, 14. In these cross-sectional widenings 38, 39, the air flows coming out of the outlet openings 36, 37 can relax and calm down before they then flow off into the yarn guiding ducts formed by the grooves 24, 25 and by the covering 31. In order to obtain a flow in this case that is as calm and uniform as possible, the cross-sectional widenings 38, 39, in the shape of flat funnels, change into the sections of the grooves 24, 25 which follow and which then have a constant cross-section extending to the common outlet opening 26.

Deflecting elements 27, 28 are arranged in the area of the transitions from the cross-sectional enlargements 38, 39 to the sections of the grooves 24, 25 which follow. These deflecting elements 27, 28 may be manufactured from a wear-proof material, such as ceramics. As a modification of the shown embodiment, the deflecting elements 27, 28 are constructed as yarn detectors according to other contemplated embodiments. In this case, they may also be constructed as no-contact yarn detectors D. A further deflection of the yarns 3, 4 takes place in the area of the yarn outlet opening 26. A wear-proof insert I is expediently also provided in the area of this deflecting point.

The holder 22 is held so that it can be pivoted around a shaft 29 which is in parallel to the shafts of the drafting units 6, 7. In the operating position, the holder 22 rests against a stop 30. The operating position is secured, for example, by a spring that is not shown. In a modified embodiment, the stop 30 is constructed as an adjusting member which can be moved out in the direction of the operating side, that is in the direction toward the open side of the grooves 24, 25. This adjusting member will then expediently be controlled by yarn detectors 27, 28 in such a manner that, when a yarn breakage is determined, the holder is automatically swivelled away into the inoperative position of the air nozzles 13, 14.

The covering 31 essentially comprises a box-shaped sheet metal frame 33 which is filled on the inside with a noise-reducing material 35. The interior surface of the covering 31 is covered by means of a metal sheet 34 which, in the closed position of the covering 31, places itself against the holder 22 and closes off the grooves 24, 25 leading to the yarn guiding ducts. In the area of the swivelling shaft 29 of the holder 22, the covering 31 is connected with the holder 22 by way of its own swivelling shaft 32. For this purpose, the holder 22 is provided with projecting brackets into which bearing pins are inserted which are fastened to the covering 31. The closed position of the covering 31 illustrated in FIGS. 1 and 2 is expediently secured by a spring which is not shown, such as a torsion spring arranged in the area of the swivel shaft 32.

For a servicing of the air nozzles 13, 14, the holder 22 can be swivelled away around its swivelling shaft 29. In order to, in this case, also make accessible the grooves 24, 25 for a servicing and in particular a cleaning, the covering 31 can be swivelled away farther from the swivelled away holder 22 so that the yarn outlet openings 36, 37 of the air nozzles 13, 14 and also the grooves 24, 25 become completely accessible.

As shown in FIG. 1, the covering 31 is provided with a notch 40 in the area of its upper edge facing the drafting units 6, 7 and facing away from the swivel shaft 32 and the swivel shaft 29 of the holder 22. This notch 40 is used as a working surface for an operating element of a movable servicing arrangement which is not shown and by means of which the structural unit of the holder 22 and the covering 31 can be swivelled back into the operating position in the case of a piecing operation.

The invention was explained above by means of an embodiment in which an arrangement produces a double yarn 5. The invention can also be used correspondingly if only an individual yarn is spun at every arrangement according to other contemplated embodiments. In this case, a holder which corresponds to holder 22 will then carry only one air nozzle 13, 14. A respective separate covering which corresponds to the covering 31 is then in each case assigned to the groove which then extends in a straight line and which, in principle, corresponds to grooves 24, 25.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for pneumatic false-twist spinning of the type having a drafting unit and pneumatic false twist apparatus downstream of the drafting unit, said arrangement comprising:

at least one air nozzle arranged downstream of a drafting unit for pneumatic twisting of a sliver, a holding plate including a recess for holding the at least one air nozzle, a yarn guiding groove arrangement formed in the plate and extending from the at least one air nozzle to a yarn outlet opening spaced from the at least one air nozzle, and a cover for the guiding groove arrangement which is sealingly engageable with the at least one air nozzle and extends to the yarn outlet opening, the cover being mounted for selective movement away from the at least one air nozzle to accommodate cleaning of the guiding groove arrangement in the plate, wherein the guiding groove arrangement has a cross-sectional enlargement adjacent an outlet of the at least one air nozzle.

2. An arrangement according to claim 1, wherein a yarn detector is arranged inside the guiding groove arrangement.

3. An arrangement according to claim 1, wherein the cover is provided with a noisereducing material.

4. An arrangement according to claim 1, wherein said at least one air nozzle includes two adjacent air nozzles, said air nozzles being held by means of a common holding plate, the guiding groove arrangement comprising yarn guiding ducts extending from each of said adjacent air nozzles to said yarn outlet opening to form a V-shape.

5. An arrangement according to claim 1, wherein said cover holding plate so that it can be swivelled away to open the guiding groove arrangement.

6. An arrangement according to claim 5, wherein the cover and the holding plate are constructed as a subassembly which can be moved jointly out of an operating spinning position and can be moved jointly back into the operating spinning position.

7. An arrangement according to claim 6, comprising a swivelling shaft arranged in an area facing downstream of the at least one air nozzle for pivotally supporting the holding plate.

8. An arrangement according to claim 5, wherein the holding plate is extended beyond the outlet area of the at least one air nozzle, and is provided with the guiding groove arrangement in the extended area.

9. An arrangement according to claim 8, comprising a swivelling shaft arranged in an area facing downstream of the at least one air nozzle for pivotally supporting the holding plate.

10. An arrangement according to claim 8, comprising a cover support swivel shaft, wherein the cover is mounted on the holding plate in the area of the swivelling shaft of the holding plate by means of the cover support swivel shaft.

11. An arrangement according to claim 10, wherein said at least one air nozzle includes two adjacent air nozzles, said air nozzles being held by means of a common holding plate, the guiding groove arrangement comprising yarn guiding ducts extending from each of said adjacent air nozzles to said yarn outlet opening to form a V-shape.

12. An arrangement according to claim 8, wherein a yarn detector is arranged inside the guiding groove arrangement.

13. An arrangement according to claim 5, comprising a swivelling shaft arranged in an area facing downstream of the at least one air nozzle for pivotally supporting the holding plate.

14. An arrangement according to claim 13, comprising a cover support swivel shaft, wherein the cover is mounted on the holding plate in the area of the swivelling shaft of the holding plate by means of the cover support swivel shaft.

15. An arrangement according to claim 13, wherein a yarn detector is arranged inside the guiding groove arrangement.

16. An arrangement according to claim 5, wherein a yarn detector is arranged inside the guiding groove arrangement.

17. An arrangement for pneumatic false-twist spinning of the type having a drafting unit and pneumatic false twist apparatus downstream of the drafting unit, said arrangement comprising:

at least one air nozzle arranged downstream of a drafting unit, a guiding groove arrangement having a yarn outlet opening arranged downstream of the at least one air nozzle, and a cover for the guiding groove arrangement that can be swivelled away, wherein the guiding groove arrangement is designed as a groove which is completed by means of the closed cover to form a yarn guiding duct which leads from the at least one air nozzle to the yarn outlet opening, and wherein the guiding groove arrangement exhibits a cross-sectional enlargement adjacent an outlet of the at least one air nozzle.

18. An arrangement according to claim 17, wherein said cover is held pivotally on the holding plate so that it can be swivelled away to open the guiding groove arrangement.

19. An arrangement according to claim 18, wherein the holding plate is extended beyond the outlet area of the at least one air nozzle, and is provided with the guiding groove arrangement in the extended area.

20. An arrangement according to claim 19, wherein the cover is mounted on the holding plate in the area of the swivelling shaft of the holding plate by means of its own swivel shaft.

21. An arrangement according to claim 20, wherein a yarn detector is arranged inside the guiding groove arrangement.

22. An arrangement according to claim 21, wherein said at least one air nozzle includes air nozzles assigned to two adjacent drafting units, said air nozzles being held by means of a common holding plate, the guiding groove arrangement of which holder, together with the cover, forms two yarn guiding ducts extending in a V-shape in the travelling direction of the yarn to a joint yarn outlet opening.

* * * * *